US011590373B2

(12) United States Patent
Shin

(10) Patent No.: US 11,590,373 B2
(45) Date of Patent: Feb. 28, 2023

(54) FIRE EXTINGUISHING SYSTEM FOR VEHICLE

(71) Applicants: Hyundai Motor Company, Seoul (KR); Kia Motors Corporation, Seoul (KR)

(72) Inventor: Hyeon Gi Shin, Gyeonggi-do (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 138 days.

(21) Appl. No.: 16/950,330

(22) Filed: Nov. 17, 2020

(65) Prior Publication Data

US 2021/0290997 A1 Sep. 23, 2021

(30) Foreign Application Priority Data

Mar. 23, 2020 (KR) ..... 10-2020-0035071

(51) Int. Cl.
*A62C 3/07* (2006.01)
*A62C 35/02* (2006.01)
*A62C 13/68* (2006.01)

(52) U.S. Cl.
CPC ..... *A62C 3/07* (2013.01); *A62C 13/68* (2013.01); *A62C 35/023* (2013.01); *A62C 35/026* (2013.01)

(58) Field of Classification Search
CPC ..... A62C 35/023; A62C 35/026; A62C 3/07; A62C 35/02; A62C 99/0018; A62C 3/08; A62C 13/68
USPC ..... 169/62; 220/724
See application file for complete search history.

(56) References Cited

U.S. PATENT DOCUMENTS 2,465,095 A * 3/1949 Harvey ..... F17C 13/06 220/327
2,557,120 A * 6/1951 Knoblock ..... A62C 13/70 222/105
7,325,622 B2 * 2/2008 Sjostrom ..... A62C 35/026 169/29
8,915,307 B2 * 12/2014 Lelic ..... A62C 31/05 239/222.11

(Continued)

FOREIGN PATENT DOCUMENTS

JP 2007-130456 A 5/2007
KR 97-0020911 U 6/1997

(Continued)

*Primary Examiner* — Christopher R Dandridge
(74) *Attorney, Agent, or Firm* — Fox Rothschild LLP

(57) ABSTRACT

A fire extinguishing system for a vehicle includes a fire detection device outputting a fire detection signal in response to detecting a fire and is installed in a predetermined space of the vehicle. A controller outputs a control signal for spraying fire extinguishing agent when the fire detection signal is received from the fire detection device. An air tank stores compressed air and a fire extinguishing agent cylinder is connected to the air tank through an air hose, is filled with the fire extinguishing agent, and is operated to discharge the fire extinguishing agent by the compressed air, supplied from the air tank through the air hose, by the control signal. A spray nozzle assembly is connected to the fire extinguishing agent cylinder through a fire extinguishing agent hose and sprays the fire extinguishing agent being supplied, from the fire extinguishing agent cylinder, through the fire extinguishing agent hose.

12 Claims, 7 Drawing Sheets

(56) References Cited

U.S. PATENT DOCUMENTS

| | | | | |
|---|---|---|---|---|
| 10,039,945 | B2 * | 8/2018 | Sandahi | B60R 16/02 |
| 10,493,305 | B2 * | 12/2019 | Senecal | A62C 13/68 |
| 2016/0346577 | A1 * | 12/2016 | Ito | A62C 5/006 |

FOREIGN PATENT DOCUMENTS

| | | | |
|---|---|---|---|
| KR | 2017-0100834 | A | 9/2017 |
| KR | 2018-0070608 | A | 6/2018 |

* cited by examiner

FIRE EXTINGUISHING SYSTEM FOR VEHICLE

CROSS REFERENCE TO RELATED APPLICATION

The present application claims priority to Korean Patent Application No. 10-2020-0035071, filed Mar. 23, 2020, the entire contents of which is incorporated herein for all purposes by this reference.

BACKGROUND

Field of the Disclosure

The present disclosure relates to a fire extinguishing system for a vehicle and, more particularly, to a fire extinguishing system for a vehicle capable of rapidly and effectively extinguishing a fire by automatically detecting the fire in the vehicle.

Description of the Related Art

In general, in a vehicle, fuel that is flammable material is used, and a number of heat sources are present within the vehicle as well as various electric wirings thus generating a fire hazard. For example, due to a high-temperature engine and various electric devices being installed in an engine room, a fire may occur when the engine or the electric devices are damaged or malfunction due to a vehicle collision or other accident. In addition, in the engine room, there is a fire hazard even during driving due to engine overheating or causes induced in an exhaust gas post-treatment process.

Recently, as the use of eco-friendly vehicles such as electric vehicles has increased, the risk of fire due to external shocks or internal short circuits has increased in batteries, high-voltage electric wiring, and the like. However, although furnishing and using a fire extinguisher, as a method of responding to a fire in a vehicle, is a known responding method, when a driver fails to use the fire extinguisher on time, extinguishing of an initial fire may fail and the fire may spread throughout the vehicle. Moreover, in the case of a public transportation vehicle such as a bus, many passengers board, and thus, fire prevention management for passenger safety is essential, and failure to respond early in the event of a fire may lead to a major catastrophe.

In addition, since the driver is indoors while driving the vehicle, even though a fire occurs inside the engine room, it may be difficult to notice the fire easily before a large amount of smoke is generated. In the case of a bus, unlike a passenger vehicle, the engine room is located at the rear of the vehicle, so it may be more difficult for the driver to detect a fire in the engine room. Therefore, the driver may not rapidly control the fire in an early stage of the fire, and the fire may spread and lead to the combustion of the vehicle, and the risk of human injury increases.

Even if the driver or passengers in the vehicle interior notice the fire quickly, it may be difficult to rapidly extinguish the fire with only a small type fire extinguisher provided in the vehicle. Accordingly, a fire extinguishing system capable of rapidly extinguishing a fire by automatically spraying a fire extinguishing agent toward an ignition point when a fire is detected in the engine room of the vehicle is known.

In the known engine room fire extinguishing system, when a fire occurs in the engine room, high pressure nitrogen charged in a nitrogen tank is supplied to the cylinder filled with the fire extinguishing agent through a hose by a fire detection signal. Accordingly, while the piston is operated in the cylinder by high pressure nitrogen, the internal fire extinguishing agent is supplied to the spray line at a high pressure by force generated by the piston, and eventually, the fire extinguishing agent is sprayed through the nozzle of the spray line to the ignition point, thereby extinguishing the fire.

In such an engine room fire extinguishing system, high pressure nitrogen is used as a driving gas for operating the piston, and a high-pressure supply hose is connected between a tank filled with high-pressure nitrogen and a cylinder filled with the fire extinguishing agent. In addition, the spray line connected to the cylinder is arranged along a predetermined position in the engine room, and a fire detection line detecting a fire in the engine room is also arranged along a predetermined position in the engine room.

Such a conventional fire extinguishing system is effective in extinguishing a fire in an inner space such as an engine room of a vehicle. For example, a fire generated in a space such as the engine room is automatically detected through a fire detection line disposed in the engine room, and a fire extinguishing agent charged in the cylinder is injected through a nozzle of a spray line disposed in the space, thus extinguishing the fire early in the engine room.

However, the above-described fire extinguishing system needs to separately store high-pressure nitrogen in a vehicle, and thus requires an expensive pressure tank to store the high-pressure nitrogen, and also requires a high-pressure supply hose to connect the nitrogen tank to a cylinder filled with fire extinguishing agent. In addition, even though the tank is charged with the high-pressure nitrogen, it is difficult to maintain the pressure state of nitrogen in the tank for a long period of time, and pressure decrease in the tank may occur due to leakage of the high-pressure nitrogen, and thus, operation may not be possible depending on the state of nitrogen in the event of an actual fire.

In addition, in a conventional engine room fire extinguishing system using the high-pressure nitrogen as a driving gas, both the tank filled with nitrogen and the cylinder (fire extinguisher cylinder) filled with the fire extinguishing agent are disposable. Therefore, the tank and the cylinder require replacement for reuse.

The foregoing is intended merely to aid in the understanding of the background of the present disclosure, and is not intended to mean that the present disclosure falls within the purview of the related art that is already known to those skilled in the art.

SUMMARY

Accordingly, the present disclosure provides a fire extinguishing system for a vehicle that rapidly and effectively extinguish a fire by automatically detecting an occurrence of a fire in a vehicle, and substantially reduce installation and maintenance costs.

To achieve the above objective, a fire extinguishing system for a vehicle according to an exemplary embodiment of the present disclosure may include a fire detection device configured to output a fire detection signal when a fire is detected and installed in a predetermined space of the vehicle; a controller configured to output a control signal for spraying fire extinguishing agent when the fire detection signal is received from the fire detection device; an air tank in which compressed air is stored; a fire extinguishing agent cylinder connected to the air tank through an air hose, filled with the fire extinguishing agent, and operated to discharge the fire extinguishing agent by the compressed air, supplied from the air tank through the air hose, by the control signal output from the controller; and a spray nozzle assembly connected to the fire extinguishing agent cylinder through a fire extinguishing agent hose and provided to spray the fire extinguishing agent being supplied, from the fire extinguishing agent cylinder, through the fire extinguishing agent hose, by being installed in the predetermined space of the vehicle.

As described above, according to the fire extinguishing system for the vehicle of the present disclosure, when a fire occurs in the vehicle, the fire may be rapidly and effectively extinguished by being automatically detected. In particular, according to the configuration of the present disclosure, not only a structure, which recharges the fire extinguishing agent to a fire extinguishing agent cylinder, is provided, but also compressed air in an existing air tank mounted in the vehicle is used as a driving gas, whereby an expensive pressure tank for nitrogen storage and accessory parts therefor are unnecessary. In addition, since there is no need to replace the tank or cylinder, there is an effect that installation and maintenance costs may be reduced significantly.

BRIEF DESCRIPTION OF THE DRAWINGS

The above and other objectives, features, and other advantages of the present disclosure will be more clearly understood from the following detailed description when taken in conjunction with the accompanying drawings, in which.

DETAILED DESCRIPTION

Figure 1:
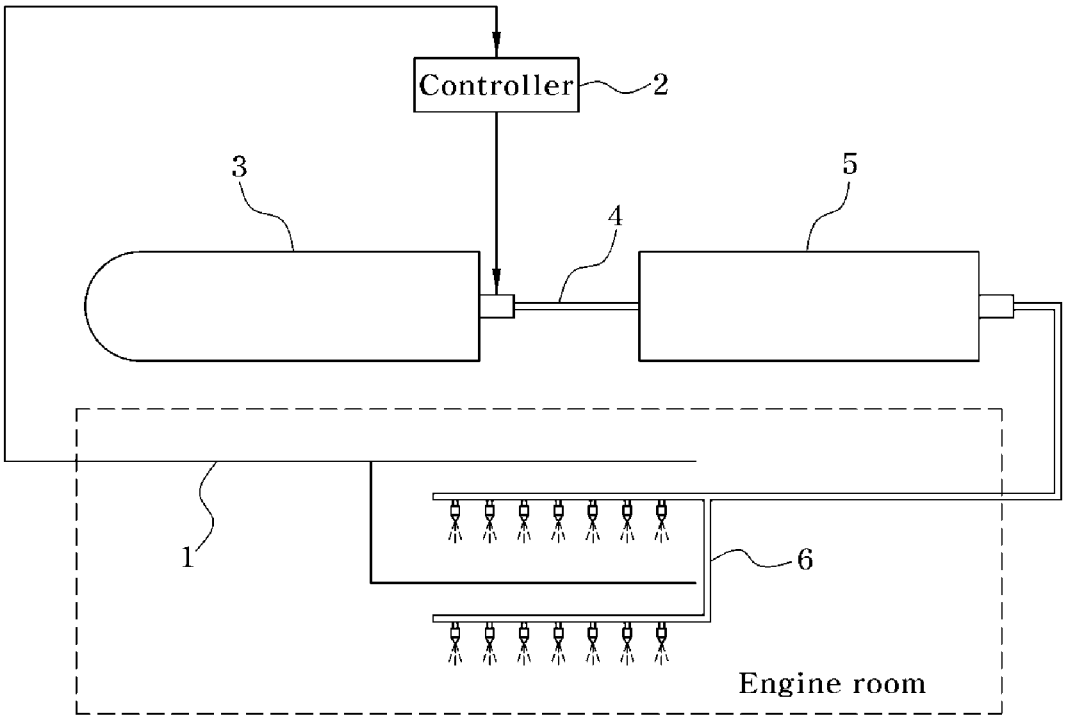
FIG. 1 PRIOR ART
FIG. 1 is a block diagram illustrating a conventional engine room fire extinguishing system according to the prior art.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g. fuels derived from resources other than petroleum). As referred to herein, a hybrid vehicle is a vehicle that has two or more sources of power, for example both gasoline-powered and electric-powered vehicles.

Although exemplary embodiment is described as using a plurality of units to perform the exemplary process, it is understood that the exemplary processes may also be performed by one or plurality of modules. Additionally, it is understood that the term controller/control unit refers to a hardware device that includes a memory and a processor and is specifically programmed to execute the processes described herein. The memory is configured to store the modules and the processor is specifically configured to execute said modules to perform one or more processes which are described further below.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising" when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

Unless specifically stated or obvious from context, as used herein, the term "about" is understood as within a range of normal tolerance in the art, for example within 2 standard deviations of the mean. "About" can be understood as within 10%, 9%, 8%, 7%, 6%, 5%, 4%, 3%, 2%, 1%, 0.5%, 0.1%, 0.05%, or 0.01% of the stated value. Unless otherwise clear from the context, all numerical values provided herein are modified by the term "about."

Herein below, exemplary embodiments of the present disclosure will be described in detail with reference to the accompanying drawings so that those skilled in the art to which the present disclosure pertains may easily implement. However, the present disclosure may be embodied in different forms and should not be limited to the embodiments set forth herein. When a certain part of the specification "includes" a certain component, this means that other components may be further included instead of excluding other components unless specifically stated otherwise.

The present disclosure is intended to provide a fire extinguishing system for a vehicle that may rapidly and effectively extinguish a fire by automatically detecting a fire within the vehicle, and reduce installation and maintenance costs. The fire extinguishing system according to the present disclosure may be provided in a vehicle to be installed in a predetermined space where a fire may occur. For example, the fire extinguishing system may extinguish a fire that has occurred in an engine room of a vehicle and, more specifically, to extinguish a fire that has occurred in an engine room provided at a rear of a bus.

Of course, the fire extinguishing system may be installed and used in a passenger vehicle in which an engine room is located in front of the vehicle and may be installed to extinguish a fire that has occurred in a predetermined space provided within the vehicle in addition to the engine room. To help to understand the present disclosure, a conventional fire extinguishing system will be described first.

FIG. 1 is a block diagram illustrating a conventional fire extinguishing system according to the prior art. As illustrated, the conventional fire extinguishing system includes a fire detection line 1 installed in a space inside the vehicle, for example, inside the engine room, a fire control unit (FCU) 2 configured to output a control signal for spraying fire extinguishing agent when a fire detection signal is received from the fire detection line 1, and a nitrogen tank 3 in which high-pressure nitrogen that is driving gas is stored, and which is provided to discharge high-pressure nitrogen when an outlet opening operation is made in accordance with the control signal that the FCU 2 outputs.

Additionally, the conventional fire extinguishing system further includes a fire extinguishing agent cylinder 5 in which the fire extinguishing agent is stored, and which is provided to discharge the fire extinguishing agent by an internal piston (not shown) operated by high-pressure nitrogen supplied from the nitrogen tank 3, a high-pressure supply hose 4 which is installed to connect between the nitrogen tank 3 and the fire extinguishing agent cylinder 5 for supplying the high-pressure nitrogen, and a spray nozzle assembly 6 which is installed inside the engine room and provided to spray the fire extinguishing agent supplied from the fire extinguishing agent cylinder 5.

In such a fire extinguishing system, when a fire occurs in the engine room, the fire detection signal generated at the fire detection line 1 is transmitted to the FCU 2, and the FCU 2 outputs an electrical signal, that is, a control signal, for spraying the fire extinguishing agent and applies the control signal to the nitrogen tank 3. Accordingly, in the nitrogen tank 3, a pin embedded in a cap of the tank is operated by the control signal output from the FCU 2, thereby piercing the metal film at a tank outlet. At this time, the tank outlet is opened and the high-pressure nitrogen in the tank is delivered to the fire extinguishing agent cylinder 5 through the high-pressure supply hose 4.

Subsequently, in the fire extinguishing agent cylinder 5, the piston moves by the action of the high-pressure nitrogen supplied from the nitrogen tank 3, thereby pressurizing the fire extinguishing agent. Accordingly, the extinguishing agent is supplied to the spray nozzle assembly 6 through an outlet of the fire extinguishing agent cylinder 5 and eventually is able to be sprayed to the inner side of the engine room through the nozzle of the spray nozzle assembly 6. In such configuration, since the high-pressure nitrogen is to be discharged as the metal film installed at the outlet of the nitrogen tank is torn by a pin, the nitrogen tank is unable to be reused after nitrogen discharge and is thus replaced with a new one.

In the same manner, since structured also to release the fire extinguishing agent only when the metal film, installed at the outlet where the fire extinguishing agent is discharged, is broken, the fire extinguisher cylinder is unable to be reused after nitrogen discharge and is thus replaced with a new one. Accordingly, the conventional fire extinguishing system has a disadvantage in that, once used, both the nitrogen tank and the fire extinguishing agent cylinder need to be replaced, and that a substantial number of separate accessories and parts such as the nitrogen tank, the high-pressure supply hose, a bracket, and the like for nitrogen supply, are required.

In addition, vibration and shock occur frequency in the vehicle, and leakage of nitrogen from the nitrogen tank filled with high-pressure nitrogen from the first installation may gradually occur due to external influences such as vibration and shock. Eventually, the conventional fire extinguishing system may not properly operate in the case of a fire in a state where the nitrogen pressure decreases. Accordingly, to solve the problem of using high-pressure nitrogen as the driving gas, an improved fire extinguishing system using compressed air as the driving gas instead of high-pressure nitrogen is disclosed.

Figure 2:
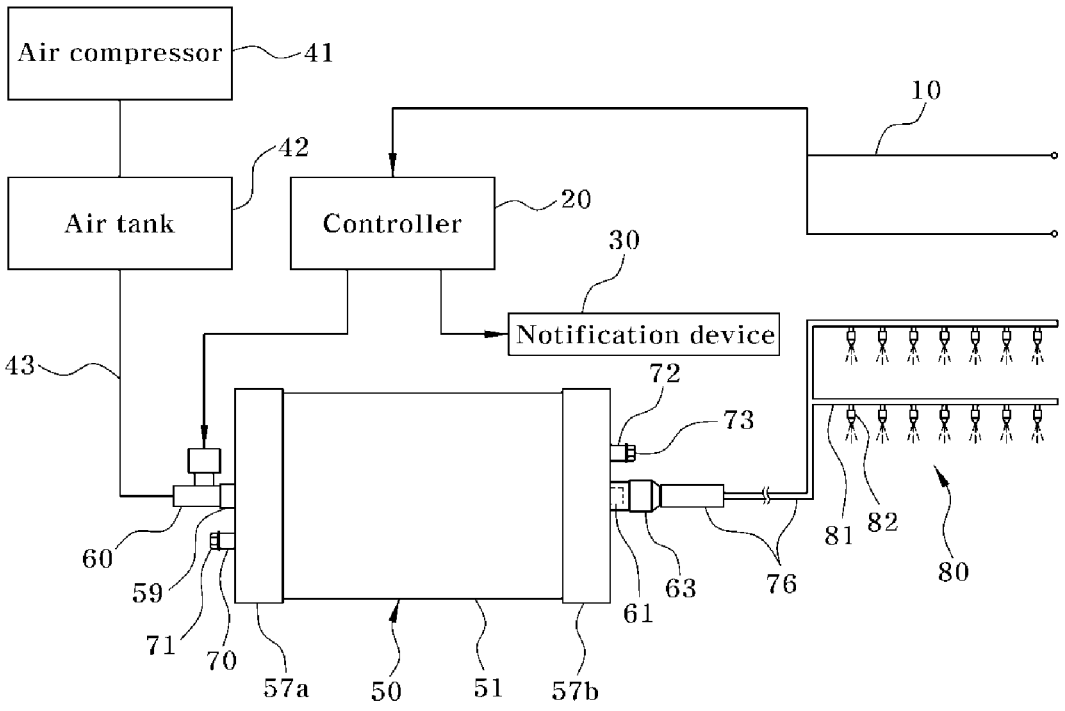
FIG. 2 is an overall configuration diagram illustrating a fire extinguishing system according to an exemplary embodiment of the present disclosure.
Figure 3:
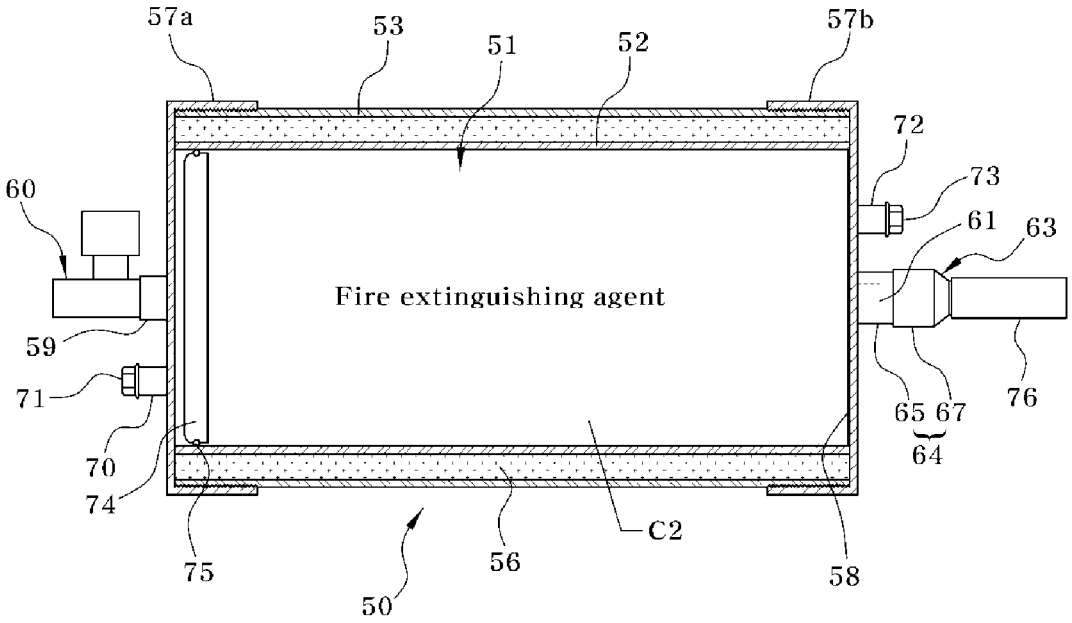
FIG. 3 and FIG. 4 are views illustrating a fire extinguishing agent cylinder and a driving gas supply source, respectively, in the fire extinguishing system according to the exemplary embodiment of the present disclosure.
Figure 4:
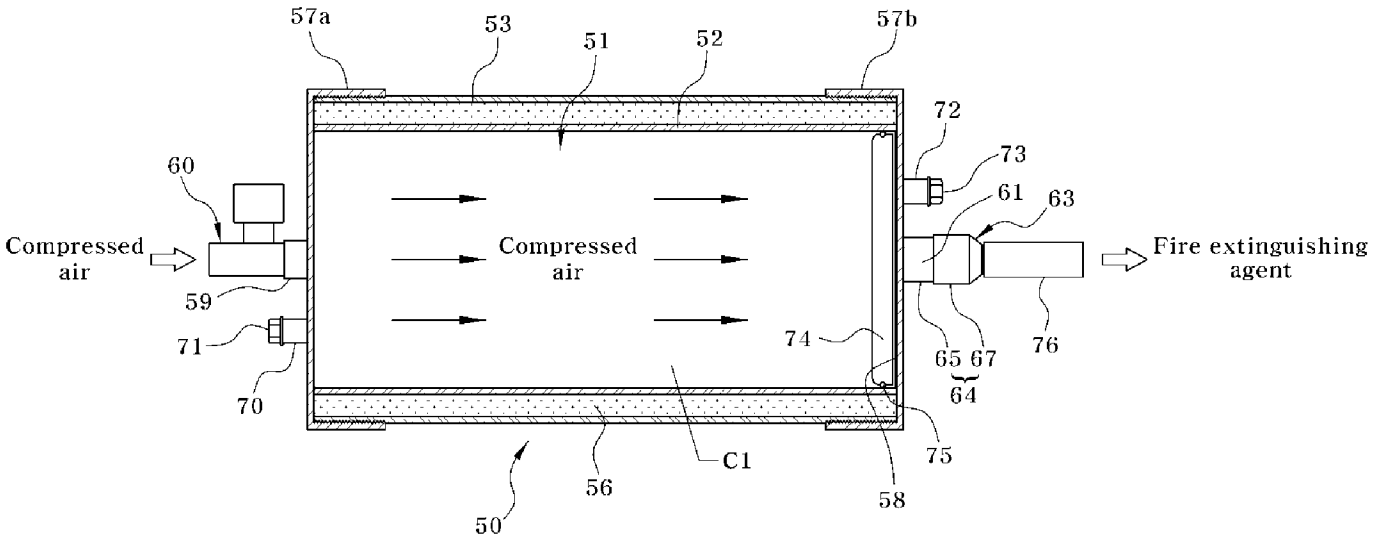

FIG. 2 is an overall configuration diagram illustrating a fire extinguishing system according to an exemplary embodiment of the present disclosure, and FIG. 3 and FIG. 4 are views illustrating a fire extinguishing agent cylinder and a driving gas supply source, respectively, in the fire extinguishing system according to the exemplary embodiment of the present disclosure. In the present disclosure, compressed air is used instead of high-pressure nitrogen as the driving gas, and to this end, an existing air tank 42 mounted in the vehicle as illustrated is used.

In the air tank 42, air compressed by the air compressor 41 may be stored at high pressure (for example, about 10 bar), and for both the air tank 42 and the air compressor 41, existing ones mounted in the vehicle may be used. As is known, the air compressor 41 and air tank 42 are essentially equipped in commercial vehicles such as trucks and buses, thereby being used to operate cabs, suspension, brakes, and the like. When the air tank 42, which is already mounted within the vehicle, is used as the driving gas supply source in this way, since it is not necessary to separately install expensive high-pressure nitrogen tanks and peripheral parts such as the brackets and the like, the installation cost may be reduced.

To describe the configuration of the exemplary embodiment with reference to FIG. 2, the fire extinguishing system according to the exemplary embodiment of the present disclosure may include a fire detection device 10 installed in a predetermined space provided within the vehicle, for example, the engine room, a controller 20 configured to output a control signal for spraying fire extinguishing agent when the fire detection signal is received from the fire detection device 10, and an air tank 42 in which compressed air that is a driving gas is stored.

Additionally, the fire extinguishing system according to the exemplary embodiment of the present disclosure may include a fire extinguishing agent cylinder 50 in which the fire extinguishing agent is stored, and which is provided to discharge the fire extinguishing agent by a piston operated by compressed air supplied from the air tank 42 through the air hose 43, and a spray nozzle assembly 80 installed in a predetermined space provided in the vehicle, that is, an inner side of the engine room and provided to spray the fire extinguishing agent supplied from the fire extinguishing agent cylinder 50 through a fire extinguishing agent hose 76.

Of the above-described configuration, the fire detection device 10 may be a fire detection line installed along a predetermined location and path inside the engine room, and the fire detection line may be connected to the controller 20 to transmit a fire detection signal thereto. A known fire detection line has a structure in which two electric wires, each covered in a conduit made of synthetic resin (e.g. PVC), are installed. When a fire occurs in the space where the fire detection line is installed, and conduits and sheath material of the wires of the fire detection line melt due to flames, the two electrical wires inside the fire detection line are in contact with each other to cause an electric short circuit.

The controller 20 may be configured to receive a current signal flowing through the conductor or a voltage signal applied between the two conductors while applying current to the conductor of the fire detection line. When a short circuit occurs in the two conductors, excess current flows through the conductors. In particular, the controller 20 may be configured to detect a short-circuit current or voltage, thereby detecting a fire. The detected short-circuit current or voltage becomes a type of an electrical signal, that is, a fire detection signal, indicating a fire occurrence, and the controller 20 may be configured to detect that a fire has occurred in the engine room from the fire detection signal transmitted from the fire detection line.

In addition, the controller 20 may be configured to output a control signal for extinguishing the fire and spraying the fire extinguishing agent in response to determining that a fire has occurred in the engine room. Subsequently, the control signal causes the compressed air that is a driving gas to be supplied into an air chamber of the fire extinguishing agent cylinder 50 as will be described later and, at the same time, causes the fire extinguishing agent stored in a fire extinguishing agent chamber C2 of the fire extinguishing agent cylinder 50 to be supplied to the spray nozzle assembly 80.

On the other hand, as described above, in the present disclosure, the compressed air may be used as the driving gas, and the existing air tank 42 mounted within the vehicle may be used as the driving gas (compressed air) supply source. The compressed air generated and supplied from the air compressor 41 may be stored in the air tank 42 of the vehicle, and the air tank 42 may be connected to an inlet side of the fire extinguishing agent cylinder 50 by the air hose 43 for the supply of the compressed air. At this time, an inlet valve 60 may be installed at the inlet side, where the compressed air is introduced, of the fire extinguishing agent cylinder 50, and the air hose 43 may be connected to the inlet valve 60.

In other words, the air hose 43 may be connected to the inlet side of the fire extinguishing agent cylinder 50 through the inlet valve 60. The inlet valve 60 is an electromagnetic valve provided to operate for opening and closing according to a control signal output from the controller 20 and is the valve for adjusting the supply of the compressed air from the air tank 42 to the fire extinguishing agent cylinder 50. As illustrated, the inlet valve 60 may be installed between the air hose 43 and an inlet port 59 of the fire extinguishing agent cylinder 50, or in the middle of the air hose 43 connecting between the air tank 42 and the fire extinguishing agent cylinder 50. The inlet valve 60 has a valve body that opens and closes an internal passage (e.g., internal passage of the valve body) through which the compressed air passes at the inlet side of the fire extinguishing agent cylinder 50 and may be a solenoid valve in which the valve body opens and closes the internal passage by being operated by a solenoid.

In the present disclosure, in response to determining that a fire has occurred, the controller 20 may be configured to output a control signal for opening the inlet valve 60. Subsequently, when the inlet valve 60 is opened by the control signal, the compressed air may be supplied from the air tank 42 to the inside of the fire extinguishing agent cylinder 50 through the air hose 43. In the present disclosure, the spray nozzle assembly 80 may be fixedly installed in an inner space of the vehicle, that is, the engine room and may be connected to an outlet side of the fire extinguishing agent cylinder 50 through the fire extinguishing agent hose 76.

The spray nozzle assembly 80 is provided to spray the fire extinguishing agent, which is supplied through the extinguishing agent hose 76 from the extinguishing agent cylinder 50, into the engine room for extinguishing the fire occurring in the engine room. In the exemplary embodiment of the present disclosure, the spray nozzle assembly 80, as illustrated in FIG. 2, may be configured to include a spray pipe 81 installed to be disposed along a predetermined path in the engine room, and a plurality of nozzles 82 installed along the spray pipe 81.

The spray pipe 81 of the spray nozzle assembly 80 may be fixedly installed in a fixed structure located in the inner space of the vehicle, for example, a vehicle body portion located inside the engine room. The nozzle 82 of the spray nozzle assembly 80 is provided to spray the fire extinguishing agent supplied into the spray pipe 81 from the fire extinguishing agent cylinder 50 through the fire extinguishing agent hose 76 into the engine room, and the plurality of nozzles 82 may be installed at predetermined intervals along the spray pipe 81 to evenly or uniformly spray or distribute the fire extinguishing agent in the engine room.

Meanwhile, the fire extinguishing agent cylinder will be described in more detail with reference to FIGS. 3 to 6. FIG. 3 is a view illustrating a state in which fire extinguishing agent cylinder 50 is filled with the fire extinguishing agent. In particular, the fire extinguishing agent cylinder 50 may include a fire extinguishing agent tank 51, and when a piston 74 is in a state of being moved to a rear end in the fire extinguishing agent tank 51, the fire extinguishing agent chamber C2 of the fire extinguishing agent tank 51 may be filled with the fire extinguishing agent.

FIG. 4 is a view illustrating a state in which the compressed air is supplied to the inside of the fire extinguishing agent cylinder 50, thereby having discharged the fire extinguishing agent. When the compressed air is supplied into the air chamber C1 in the extinguishing agent tank 51 through the inlet port 59, the piston 74 moves forward by the pressure of the compressed air in the fire extinguishing agent tank 51. At this time, the piston 74 pressurizes the fire extinguishing agent in the fire extinguishing agent chamber C2, and eventually the fire extinguishing agent in the fire extinguishing agent chamber C2 is discharged to the fire extinguishing agent hose 76 through the outlet port 61.

Figure 5:
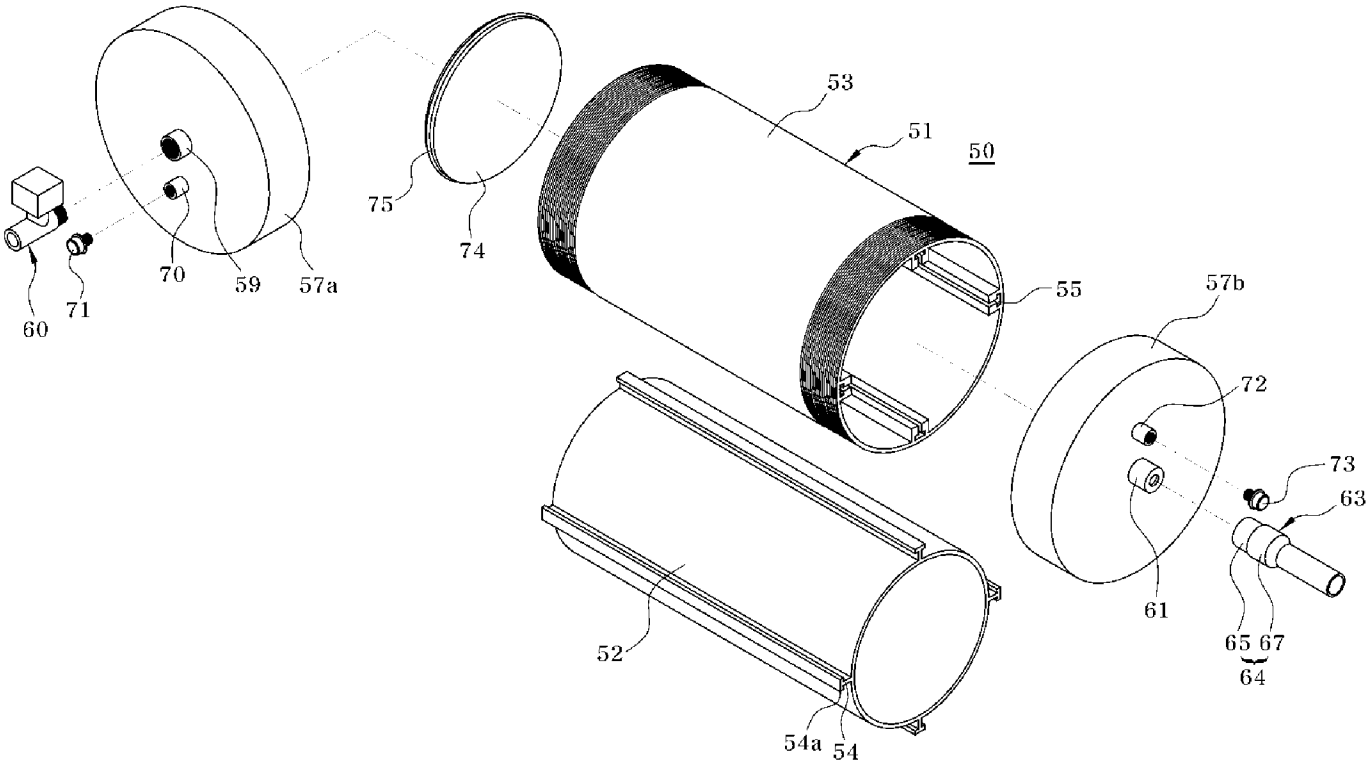
FIG. 5 is an exploded perspective view illustrating a configuration of the fire extinguishing agent cylinder in the fire extinguishing system according to the exemplary embodiment of the present disclosure.
Figure 6:
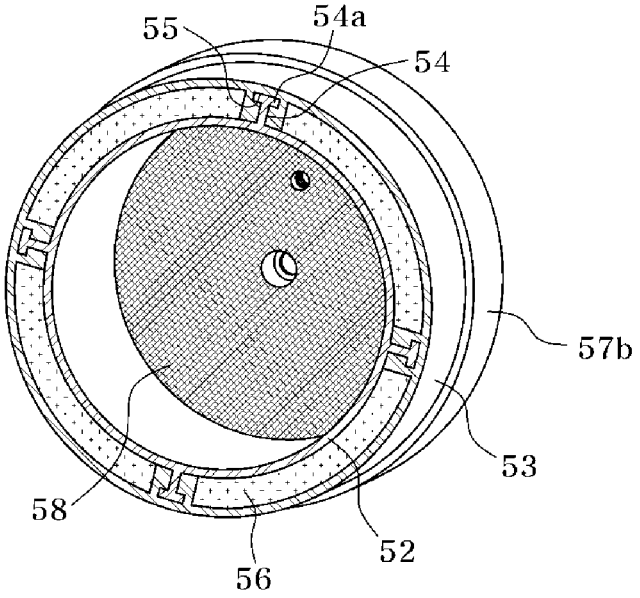
FIG. 6 is a cut-away perspective view illustrating a transverse sectional structure of a fire extinguishing agent tank in the fire extinguishing system according to the exemplary embodiment of the present disclosure.

FIG. 5 is an exploded perspective view illustrating a configuration of the fire extinguishing agent cylinder in the fire extinguishing system according to the exemplary embodiment of the present disclosure, and FIG. 6 is a cut-away perspective view illustrating a transverse sectional structure of a fire extinguishing agent tank in the fire extinguishing system according to the exemplary embodiment of the present disclosure. In the present disclosure, the fire extinguishing agent may be a liquid fire extinguishing agent, that is, a fire extinguishing solution, and is stored inside the fire extinguishing agent cylinder 50.

As illustrated, the fire extinguishing agent cylinder 50 may include: the fire extinguishing agent tank 51 having an inner space of a predetermined volume, the inlet valve 60 installed at the inlet side of the fire extinguishing agent tank 51, an outlet valve 63 installed at the outlet side of the fire extinguishing agent tank 51, and the piston 74 pressurizing for the fire extinguishing agent to be discharged from the outlet port 61 by being operated by the compressed air (e.g., driving gas) supplied through the inlet port 59 in the inner space of the fire extinguishing agent tank 51.

Particularly, the inlet valve 60 is an electromagnetic valve that opens and closes the inlet side of the fire extinguishing agent cylinder 50 (e.g., fire extinguishing agent tank) according to the control signal of the controller 20 as described above. When the inlet valve 60 is operated to open by a control signal output from the controller 20 in the event of a fire, the compressed air of high pressure (e.g. about 10 bar) may become to be supplied to the air chamber C1 in the extinguishing agent tank 51 from the air tank 42 through the air hose 43.

The fire extinguishing agent tank 51 may be a tank having a cylindrical shape, and the inlet port 59 through which the compressed air is supplied may be provided at a first end of the fire extinguishing agent tank 51, and the outlet port 61 through which the fire extinguishing agent is discharged may be provided at a second end (e.g., opposite to the first end) of the fire extinguishing agent tank 51. In the exemplary embodiment of the present disclosure, the fire extinguishing agent tank 51 may be configured as a double tube structure in which an inner tube and an outer tube are spaced apart at a predetermined interval.

Specifically, the fire extinguishing agent tank 51 may include a main body 52 which is the inner tube in a cylindrical shape having open opposite ends, a protection cover 53, which disposed by being spaced apart at an interval at the outer side of the main body to surround the main body 52 and is the outer tube in a cylindrical shape having open opposite ends, and caps 57*a* and 57*b* installed to seal the main body 52 by being coupled to opposite ends of the protection cover 53, respectively.

As illustrated in FIG. 5, in the fire extinguishing agent tank 51, both the main body 52, which is the inner tube, and the protection cover 53, which is the outer tube, may be provided in the shape of a cylindrical tube with open opposite ends, and the main body 52 and the protection cover 53 may be assembled to be concentrically disposed on the inside and outside, respectively. In other words, the main body 52 may be disposed inward, and the protection cover 53 may be disposed outward, thereby being assembled, and the main body 52 and the protection cover 53 concentrically disposed may be spaced apart from each other at a predetermined interval.

Accordingly, a gap between an outer circumferential surface of the main body 52 and an inner circumferential surface of the protection cover 53 may be coupled by the connection part 54. In other words, by the protrusion 54*a* provided in the connection part 54 and the coupling groove 55 to which the protrusion is inserted-coupled, the main body 52 and the protection cover 53 may become to be coupled to each other at a predetermined interval. Particularly, on either one of the outer circumferential surface of the main body 52 and the inner circumferential surface of the protection cover 53, the connection part 54 that connects both surfaces to each other and maintains the gap between the two surfaces is provided in a protruding manner. In addition, the protrusion 54*a* may be provided at an end portion of the connection part 54. In addition, on a remaining one of the outer circumferential surface of the main body 52 and the inner circumferential surface of the protection cover 53, the coupling groove 55, to which the end portion of the connection part 54 including the protrusion 54*a* is inserted-coupled, is provided.

In the exemplary embodiment of FIG. 5 and FIG. 6, the connection part 54 may be provided on the outer circumferential surface of the main body 52, and the coupling groove 55 may be provided on the inner circumferential surface of the protection cover 53. In particular, the connection part 54 and the coupling groove 55 may be provided at mutually corresponding positions and corresponding regions on surfaces, on both sides, facing each other of the main body 52 and the protection cover 53, respectively. Differently from the exemplary embodiment of FIG. 5 and FIG. 6, although not illustrated in the drawing, the coupling groove 55 may be provided on the outer circumferential surface of the main body 52, and the connection part 54 may be provided on the inner circumferential surface of the protection cover 53.

In the exemplary embodiment of the present disclosure, the plurality of connection parts 54 may be provided on either one of the outer circumferential surface of the main body 52 and the inner circumferential surface of the protection cover 53, and the plurality of coupling grooves 55 may be provided on corresponding regions of the remaining one of the main body 52 and the inner circumferential surface of the protection cover 53. In the exemplary embodiment of the present disclosure, a plurality of the connection parts 54 and a plurality of coupling grooves 55 may be provided in a long, side by side, and continuous shape along a front-rear axis direction on the surface of the main body 52 or protection cover 53, that is, along a longitudinal direction of the main body and protection cover.

In the exemplary embodiment of the present disclosure, the protrusion 54*a* of the connection part 54 may protrude a width direction of the connection part at the end portion of the connection part. In other words, the protrusion 54*a* may protrude in opposite directions at the end portion of each of the connection parts 54. At this time, the connection part 54 including the protrusion 54*a* and the coupling groove 55 have respective predetermined cross-sectional shapes in all sections in the longitudinal direction. Accordingly, when the end portion, including the protrusion 54*a*, of the connection part 54 may be inserted into the coupling groove 55, the protrusion 54*a* and the end portion of the connection part 54 are provided to be slidable in the longitudinal direction at the inside of the coupling groove 55.

Eventually, the main body 52 may be inserted into the protection cover 53, thereby being assembled, wherein the end portion, including the protrusion 54*a*, of the connection part 54 may be inserted into an inner side of the coupling groove 55 on the facing surface. Subsequently, the end portion above may be slid in the longitudinal direction, and then both sides of the main body and the protection cover may be coupled to locate the main body 52 at the inside of the protection cover 53. Accordingly, the main body 52 and the protection cover 53 may be coupled to each other, and in particular, the protection cover 53 and the main body 52 may be coupled to each other in a state of being disposed at the outer side and the inner side, respectively, by being spaced apart at a predetermined interval.

In the exemplary embodiment of the present disclosure, the plurality of connection parts 54 and the same number of the coupling grooves 55 may be provided to be disposed at equal intervals along the circumferential direction of the main body 52 and the protection cover 53, respectively. In the exemplary embodiment of FIG. 5 and FIG. 6, a total of the four connection parts 54 and a total of the four coupling grooves 55 are each provided at intervals of about 90° degree in the circumferential direction. This is merely exemplary, and the present disclosure is not limited by this particular interval, and the number of the connection parts 54 and the engaging grooves 55 and the intervals thereof may be changed.

The reason why the fire extinguishing agent tank 51 is configured as a double tube structure as described above is that, when only the main body 52 is present, a stamping may occur on the main body 52 during transportation or during assembly, and in this case, the piston 74 inside the main body may not be moved by being caught by the stamping portion during operation. Therefore, the protection cover 53 that protects the main body 52 from being damaged may be disposed outside the main body 52, and to prevent the main body 52 from being damaged even when an impact is applied to the protection cover 53, the main body 52 and the protection cover 53 are spaced apart.

In the exemplary embodiment of the present disclosure, thermal insulation material 56 may be inserted into separated space between the main body 52 and the protection cover 53, and through this, the heat resistance temperature specification of the fire extinguishing agent tank 51 and the fire extinguishing agent cylinder 50 may be increased. In the conventional fire extinguishing system, since the thermal insulation material 56 is not applied to the fire extinguishing agent cylinder 50, the heat-resistance temperature specification of the fire extinguishing agent cylinder 50 is relatively low, that is, no greater than 70° C. On the other hand, the internal temperature of the engine room of the bus is usually no less than 80° C., so the fire extinguishing agent cylinder 50 was not allowed to be installed in the engine room.

Therefore, there was a difficulty in designing the vehicle layout since a separate space for installing the fire extinguishing agent cylinder 50 was required other than the engine room. In addition, there was a disadvantage in terms of component placement as well as cost in accordance with the length of the fire extinguishing agent hose 76 connecting the fire extinguishing agent cylinder 50 and the spray nozzle assembly 80 becoming long.

On the other hand, in the present disclosure, it may be possible to mount the fire extinguishing agent cylinder 50 in the engine room having high temperature since the fire extinguishing agent tank 51 of the fire extinguishing agent cylinder 50 is structured in a double tube structure, and the insulating material 56 may be installed inside the double tube structure. In addition, as the heat-resistant temperature specification increases, there is more space available for mounting, which is advantageous when designing layouts.

When the main body 52 and the protection cover 53 are coupled to each other, the caps 57*a* and 57*b* are coupled to opposite ends of the protection cover, respectively, and inner spaces of the main body 52 and the protection cover 53 may be sealed as the caps are coupled. In the exemplary embodiment of the present disclosure, the caps 57*a* and 57*b* may be screwed to the opposite ends of the protection cover 53, and to this end, threads are provided on inner circumferential surfaces of the caps 57*a* and 57*b*, respectively, and the outer circumferential surfaces of the opposite ends, respectively, of the protection cover 53 so that the inner circumferential surface of each of the caps may be screwed to each of the surfaces of the protection cover, correspondingly.

When the caps 57*a* and 57*b* on the opposite sides are each screwed to the protection cover 53, the opposite ends of the main body 52 are in close contact with the inner surfaces of the caps 57*a* and 57*b*, respectively, thereby sealing the inner space of the main body. At this time, to increase the adhesion between the inner surfaces of the caps 57*a* and 57*b* and the opposite ends of the main body 52, respectively, and to prevent the fire extinguishing agent from leaking into a gap between each of the caps and the main body, a pad 58 made of elastic material that seals the gap between each of the caps and the main body may be attached to the inner surface of each of the caps 57*a* and 57*b* with which the opposite ends of the main body 52 come into contact, respectively. In particular, the pad 58 may be a rubber pad 58.

Thus, after installing the piston 74 inside the main body 52 in a state where the main body 52 and the protection cover 53 are assembled, the caps 57*a* and 57*b* may be assembled by being screwed to the opposite ends of the protection cover 53, respectively, whereby the inner space of the main body 52 may be sealed. At this time, the opposite ends of the main body 52 are in close contact with the pads 58 attached to the inner surfaces of the caps 57*a* and 57*b*, respectively, thus removing the gap between the main body 52 and the caps 57*a* and 57*b*. Accordingly, as the internal body of the main body may be filled with the fire extinguishing agent in a state of being completely sealed, the fire extinguishing agent may be prevented from being leaked.

In the exemplary embodiment of the present disclosure, one of the two caps on opposite sides becomes an inlet side cap 57*a*, and another one of the two caps on the opposite sides becomes an outlet side cap 57*b*. In addition, the inlet port 59 in a shape protruding outward may be provided at the inlet side cap 57*a* on the inlet side, and the inlet port 59 is an inlet port of the fire extinguishing agent cylinder 50 as well as an inlet port of the fire extinguishing agent tank 51, and the air hose 43 may be connected to the inlet port 59 with the inlet valve 60 as a medium.

Further, the outlet port 61 in a shape protruding outward may be provided at the outlet side cap 57*b* on the outlet side, and the outlet port 61 is an outlet port of the fire extinguishing agent cylinder 50 as well as an outlet port of the fire extinguishing agent tank 51, and the fire extinguishing agent hose 76 may be connected to the outlet port 61 with the outlet valve 63 as a medium. In addition, an air discharge port 70 connected to the air chamber C1 provided by the main body 52 may be separately provided at the inlet side cap 57*a* on the inlet side, and a filling port 72 connected to the fire extinguishing agent chamber C2 provided by the main body 52 may be separately provided at the outlet side cap 57*b* on the outlet side, wherein plugs 71 and 73 are detachably coupled to the air discharge port 70 and the filling port 72, respectively, for sealing.

In particular, the plugs 71 and 73 operate as stoppers for blocking the internal passages of the ports 70 and 72, respectively, and may be provided to be inserted into and screwed to the corresponding port. Accordingly, threads are provided on the inner circumferential surfaces of the ports, respectively, and on the outer circumferential surfaces of the plug bodies inserted to the insides of the ports, respectively. On the other hand, the piston 74 is provided in a type of a plate with predetermined thickness as illustrated in FIG. 4 and specifically, installed transversely at the inner space of the main body 52 in the fire extinguishing agent cylinder 50.

The piston 74 divides the inner space of the main body 52 into two spaces, wherein the inner space of the main body may be divided into the air chamber C1 filled with air supplied when the inlet valve 60 is opened and the fire extinguishing agent chamber C2 filled with the fire extinguishing agent, by the horizontally installed piston. In other words, the inner space of the fire extinguishing agent tank 51 may be divided into the air chamber C1 and the fire extinguishing agent chamber C2 with the piston 74 as a boundary, and shape of the piston 74 should be the same as the cross-sectional shape of the main body 52 for complete separation and division of the two spaces. Accordingly, when the cross-sectional shape of the main body is circular, the shape of the piston should also be circular.

In addition, an O-ring 75 may be installed on a circumferential surface of the piston 74 contacting an inner surface of the main body 52 to maintain airtightness with the inner surface of the main body. When the compressed air is supplied into the fire extinguishing agent tank 51, the piston 74 pushes for the fire extinguishing agent out to spray, by the pressure of the compressed air. In other words, the piston 74 serves as a pressure transmission plate that pressurizes the fire extinguishing agent while delivering the pressure of the compressed air supplied to the air chamber C1 of the main body 52 to the fire extinguishing agent contained in the fire extinguishing agent chamber C2.

Eventually, as illustrated in FIG. 3, the piston 74 is positioned at the rear as maximally as possible to secure the space of the fire extinguishing agent chamber C2 to the maximum volume. Subsequently, the filling port 72 is opened after removing the plug 73, and then the fire extinguishing agent chamber C2 may be filled with fire extinguishing agent through the opened filling port 72. After filling the fire extinguishing agent as above, the filling port 72 may be blocked by recoupling the plug 73 thereto.

During the fire extinguishing operation, the inlet valve 60 may be opened, and the compressed air may be injected through the inlet port 59 to the inside of the fire extinguishing agent cylinder 50, that is, the air chamber C1 which is the space inside the main body 52 of the fire extinguishing agent tank 51, whereby the injected compressed air pushes the piston 74 out. At this time, the piston 74 may be moved forward by the pressure of the compressed air, wherein the piston 74 moving forward pressurizes the fire extinguishing agent, which is contained in the fire extinguishing agent chamber C2 of the main body 52, thereby pushing the fire extinguishing agent out through the outlet port 61. Eventually, the fire extinguishing agent may be sprayed into the engine room through the spray nozzle assembly 80 to extinguish the fire.

As described above, when an operation of both the fire extinguishing agent spraying and the fire extinguishing is completed after the piston 74 is moved forward in the main body 52 to the maximum, the fire extinguishing agent chamber C2 of the main body 52 may be refilled with the fire extinguishing agent. Accordingly, the plug 71 of the air discharge port 70 is first separated to open the air discharge port, and then the plug 73 of the charging port 72 is separated to open the charging port. Subsequently, the fire extinguishing agent chamber C2 may be refilled with the fire extinguishing agent through the charging port 72.

While the fire extinguishing agent chamber C2 is filled with the fire extinguishing agent, the air in the air chamber C1 may be discharged through the air discharge port 70 and at the same time, the piston 74 moves to the rear, and then the fire extinguishing agent chamber C2 may be filled with the fire extinguishing agent until a state, where the piston 74 moves rearward to the maximum, is reached. Once the fire extinguishing agent chamber C2 is filled with the fire extinguishing agent, and provided that the filling port 72 is closed by coupling the plug 73 thereto, and then the air discharge port 70 is closed by coupling the plug 71 thereto, a refilling process of the fire extinguishing agent chamber C2 with the fire extinguishing agent is completed.

In the conventional fire extinguishing system, the fire extinguishing agent tank also has a structure in which a metal film is pierced as in the nitrogen tank when the pressure of the extinguishing agent is no less than a predetermined pressure, and thus, the entire fire extinguishing agent cylinder is required to be replaced after used in case of the fire. On the other hand, in the fire extinguishing system according to the present disclosure, it may be possible to refill the fire extinguishing agent chamber C2 with the fire extinguishing agent through the charging port 72 after opening the air discharge port 70 and the filling port 72 by opening the plugs 71 and 73 on the opposite sides, respectively. In addition, it is only necessary to simply refill the fire extinguishing agent chamber C2 with the fire extinguishing agent without replacing the fire extinguishing agent tank 51. Therefore, it is advantageous in terms of maintenance cost compared to the conventional one.

In the exemplary embodiment of the present disclosure, the outlet valve 63 may be installed at the outlet port 61 of the fire extinguishing agent cylinder 50 as described above, wherein the outlet valve 63 may have a configuration of a safety valve that opens an internal passage when a pressure of no less than a predetermined level is applied, and a configuration of a check valve that prevents a backflow of fluid.

A main function of the outlet valve 63 is to close the outlet port 61 of the fire extinguishing agent tank 51 in normal times and to open the outlet port 61 when the pressure of the fire extinguishing agent in the fire extinguishing agent chamber C2 reaches a value of no less than a predetermined level when the piston 74 in the fire extinguishing agent tank 51 pressurizes the fire extinguishing agent in the fire extinguishing agent chamber C2 by moving forward with the pressure of the compressed air, when fire extinguishing is operated. Accordingly, the outlet valve 63 may maintain a closed state in normal times when the pressure of the fire extinguishing agent in the fire extinguishing agent chamber C2 is not significantly applied thereto and may be opened when the pressure (e.g. about eight to nine bar), of the fire extinguishing agent, of no less than a predetermined level is applied thereto.

Figure 7:
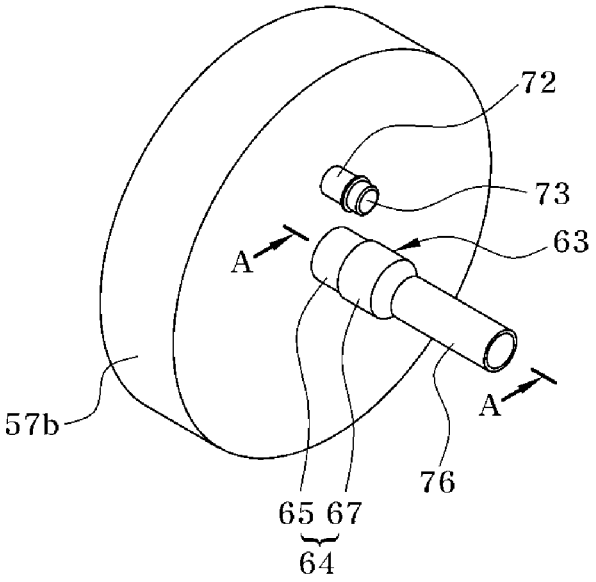
FIG. 7 is a perspective view illustrating a state in which an outlet valve of the fire extinguishing agent cylinder is installed in the fire extinguishing system according to the exemplary embodiment of the present disclosure.
Figure 8:
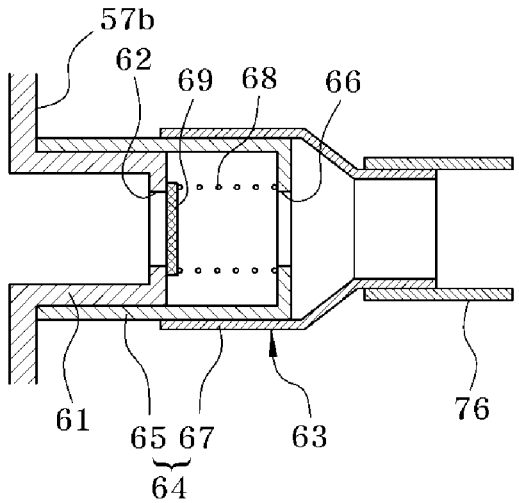
FIG. 8 and FIG. 9 are sectional views illustrating operating states, respectively, of the outlet valve in the fire extinguishing system according to the exemplary embodiment of the present disclosure.
Figure 9:
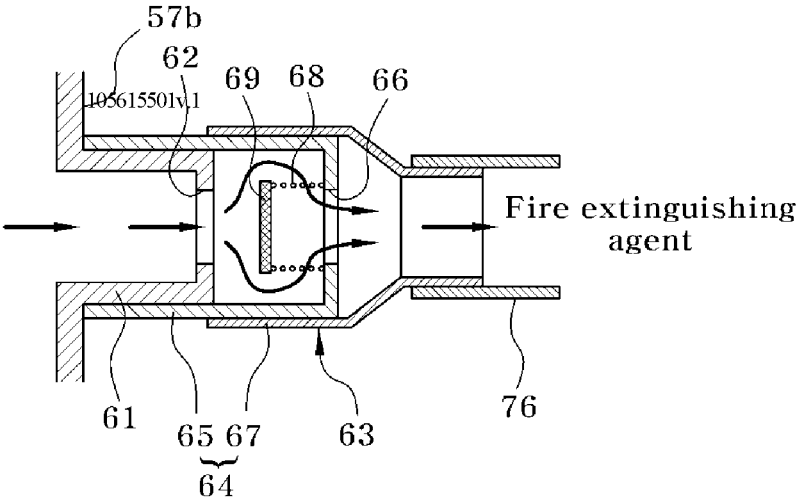

FIG. 7 is a perspective view illustrating a state in which an outlet valve of the fire extinguishing agent cylinder is installed in the fire extinguishing system according to the exemplary embodiment of the present disclosure, and FIG. 8 and FIG. 9 are sectional views illustrating operating states, respectively, of the outlet valve in the fire extinguishing system according to the exemplary embodiment of the present disclosure. FIG. 8 and FIG. 9 are sectional views taken along the line A-A of FIG. 7, and FIG. 8 shows a state in which the outlet valve 63 is closed while FIG. 9 shows a state in which the outlet valve 63 is opened.

In the exemplary embodiment of the present disclosure, the outlet valve 63 may include a hose connection adapter 64 installed at the outlet port 61 which is the outlet side of the fire extinguishing agent cylinder 50 and to which the fire extinguishing agent hose 76 is connected, an opening and closing member 69 installed at the inner side of the hose connection adapter 64 to open and close the outlet hole 62 of the outlet port 61 and moving to open the outlet hole of the outlet port by a pressure of the fire extinguishing agent of no less than a predetermined level acting through the outlet hole of the outlet port, and a valve spring 68 that provides elastic restoring force, in a direction of closing the outlet hole 62 of the outlet port 61, on the opening and closing member 69 by being installed at the inner side of the hose connection adapter 64 to elastically support the opening and closing member 69.

To describe in more detail, in the fire extinguishing agent cylinder 50 as illustrated in FIG. 7, the hose connection adapter 64 may be coupled to the outlet port 61, that is, the outlet port 61 in a cylindrical shape provided at the outlet side cap 57*b* on the outlet side of the fire extinguishing agent tank 51, and the fire extinguishing agent hose 76 may be connected to the hose connection adapter 64. The hose connection adapter 64 is a part that connects the fire extinguishing agent hose 76 to the outlet port 61 of the fire extinguishing agent cylinder 50, and operates as a valve housing of the outlet valve 63.

As illustrated in FIG. 8 and FIG. 9, the hose connection adapter 64 may be configured to include a mounting cap 65 in a cylindrical shape screwed to an outer circumferential surface of the outlet port 61, and an adapter housing 67 in a cylindrical shape screwed to an outer circumferential surface of the mounting cap 65. In such a configuration, the mounting cap 65 of the hose connection adapter 64 operates as the valve housing, and the remaining parts of the outlet valve 63 may be installed at the inner side of the mounting cap 65.

An internal passage of the outlet port 61 of the fire extinguishing agent tank 51 may communicate with the fire extinguishing agent chamber C2 that is a space defined inside the fire extinguishing agent tank filled with the fire extinguishing agent, and the outlet hole 62 penetrating through the central portion of an end of the mounting cap 65 is provided. In addition, a discharge aperture 66 penetrating through the central portion of an end of the mounting cap 65 coupled to an outer side of the outlet port 61 is provided, and a space is present between the end of the mounting cap 65 and the end of outlet port 61.

In the above space, the valve spring 68, and the opening and closing member 69 that opens and closes the outlet hole 62 of the outlet port 61 in a state of being supported by the valve spring 68 may be installed. The valve spring 68 may have a first end supported on an inner surface of the end of the mounting cap 65 and a second end (e.g., opposite to the first end) connected to the opening and closing member 69. In particular, when the pressure of the fire extinguishing agent is in a state of not reaching a pressure of no less than a predetermined level, as shown in FIG. 8, the opening and closing member 69 closes the outlet hole 62 of the outlet port 61 when being in a state of being closely contacted to an outer surface of the end of the outlet port 61 in a state of being supported by the valve spring 68.

On the other hand, when the pressure of the fire extinguishing agent, which is contained in the fire extinguishing agent chamber C2 of the fire extinguishing agent tank 51 and in the internal passage of the outlet port 61, becomes a level of no less than a predetermined level, as shown in FIG. 9, the opening and closing member 69 moves by the pressure of the fire extinguishing agent 69 while overcoming the force of the valve spring 68, thereby opening the outlet hole 62 of the outlet port 61.

As shown in FIG. 9, the opening and closing member 69 moves forward while compressing the valve spring 68 when the pressure of the fire extinguishing agent of no less than the predetermined level is applied. At this time, when the opening and closing member 69 opens the outlet hole 62 by being spaced apart from the end of the outlet port 61, the fire extinguishing agent discharged from the outlet port 61 through the outlet hole 62 passes through space on the flank of the opening and closing member 69 at the inside of the mounting cap 65 and may be discharged into the inner side of the adapter housing 67 through the discharge aperture 66 of the mounting cap 65.

As a result, the fire extinguishing agent discharged into the adapter housing 67 may be supplied to the spray nozzle assembly 80 through the fire extinguishing agent hose 76. In this way, the configuration of the fire extinguishing system according to the exemplary embodiment of the present disclosure has been described. Hereinafter, the operating state of the fire extinguishing system will be described. First, when a fire occurs in the engine room, the fire may be detected using the fire detection device 10, and the controller 20 may be configured to receive a fire detection signal from the fire detection device 10 to recognize the fire in the engine room.

At this time, the controller 20 may be configured to operate a notification device 30 installed in the vehicle to notify the driver of the fire in the engine room. In particular, the notification device 30 may be at least one of a sound output device, a display device, and a lamp installed in the vehicle and operated to notify a fire occurrence in response to a control signal output from the controller 20. The sound output device may be a buzzer installed in the interior or exterior of the vehicle, the display device may be a display installed in a cluster or other in-vehicle display (e.g. AVN display), and the lamp may be a waning lamp installed in the cluster, or in the interior or exterior of the vehicle.

Additionally, the controller 20 may be configured to output a control signal for spraying the fire extinguishing agent, wherein the inlet valve 60 may be opened according to the control signal that controller 20 outputs. When the inlet valve 60 is opened, the compressed air stored in the air tank 42 may be supplied to the fire extinguishing agent cylinder 50 through an air hose. At this time, the compressed air may be supplied to the air chamber inside the fire extinguishing agent tank 51 through an inlet of the extinguishing agent cylinder 50, that is, the inlet port 59 of the fire extinguishing agent tank 51, and the piston 74 moves forward by the pressure of the compressed air, thereby pushing the fire extinguishing agent contained in the extinguishing agent chamber C2.

At the same time, the controller 20 may be configured to operate the air compressor 41 to continuously maintain the pressure of the compressed air supplied from the air tank 42 to prevent a pressure drop from occurring. Accordingly, when the pressure of the fire extinguishing agent increases to a pressure of no less than a predetermined pressure, the outlet valve 63 may be opened, and the fire extinguishing agent in the fire extinguishing agent tank 51 may be supplied to the fire extinguishing agent hose 76 through the fire extinguishing agent adapter 64. Eventually, the fire extinguishing agent may be sprayed into the engine room through the spray nozzle assembly 80 to extinguish the fire.

Thereafter, the controller 20 may be configured to close the inlet valve 60 again when a predetermined set time elapses from the time when the inlet valve 60 is opened. For example, when about 10 liters l of the fire extinguishing agent stored in the fire extinguishing agent tank 51 takes about 40 seconds to be sprayed through the spray nozzle assembly 80, the controller 20 may be set to automatically close the inlet valve 60 again after about 2 minutes from the time of opening the inlet valve 60.

The exemplary embodiments of the present disclosure have been described in detail above, but the scope of rights of the present disclosure is not limited thereto, and various modifications and improvements of the skilled person in the art using the basic concept of the present disclosure as defined in the following claims are also included in the scope of the present disclosure.

What is claimed is:

1. A fire extinguishing system for a vehicle, comprising:

a fire detection device configured to output a fire detection signal in response to detecting a fire, wherein the fire detection device is installed in a predetermined space of the vehicle;

a controller configured to output a control signal for spraying a fire extinguishing agent in response to receiving the fire detection signal from the fire detection device;

an air tank in which a compressed air is stored;

a fire extinguishing agent cylinder connected to the air tank through an air hose, filled with the fire extinguishing agent, and operated to discharge the fire extinguishing agent by the compressed air, supplied from the air tank through the air hose, by the control signal output from the controller; and a spray nozzle assembly connected to the fire extinguishing agent cylinder through a fire extinguishing agent hose and provided to spray the fire extinguishing agent being supplied, from the fire extinguishing agent cylinder, through the fire extinguishing agent hose, by being installed in the predetermined space of the vehicle, wherein the fire extinguishing agent tank includes:

a main body installed with the piston therein, wherein the main body is an inner tube having open opposite ends; and a protection cover disposed spaced apart at an interval at an outer side of the main body to surround the main body, wherein the protection cover is an outer tube having open opposite ends, wherein the fire extinguishing agent cylinder includes a fire extinguishing agent tank filled with the fire extinguishing agent, and having an inlet port through which the compressed air is supplied and an outlet port through which the fire extinguishing agent is discharged by being connected to the fire extinguishing agent hose, wherein the fire extinguishing agent tank includes a main body filled with the fire extinguishing agent, wherein the main body is an inner tube having open opposite ends, and a protection cover disposed spaced apart at an interval at an outer side of the main body to surround the main body, wherein the protection cover is an outer tube having open opposite ends, wherein a connection part is disposed to connect between an outer circumferential surface of the main body and an inner circumferential surface of the protection cover to maintain a gap between the outer circumferential surface of the main body and the inner circumferential surface of the protection cover by the connection part, and wherein the connection part protrudes on one of the outer circumferential surface of the main body and the inner circumferential surface of the protection cover, a protrusion protrudes in a width direction at an end portion of the connection part, and a coupling groove to which the protrusion of the connection part is insertedly-coupled is provided on a remaining one of the outer circumferential surface of the main body and the inner circumferential surface of the protection cover.

2. The system of claim 1, wherein the predetermined space of the vehicle is an engine room.

3. The system of claim 1, wherein the fire extinguishing agent cylinder includes an inlet valve installed at an inlet side, to which the air hose is connected, and opened by the control signal output by the controller to supply the compressed air from the air hose through the inlet side to an inside of the fire extinguishing agent cylinder.

4. The system of claim 1, wherein the fire extinguishing agent cylinder includes an outlet valve configured to open to discharge the fire extinguishing agent inside the cylinder through the outlet side to the fire extinguishing agent hose according to a pressure state of the fire extinguishing agent filled inside the cylinder by being installed at an outlet side to which the fire extinguishing agent hose is connected.

5. The system of claim 4, wherein the outlet valve is configured to open when a pressure of the fire extinguishing agent in the fire extinguishing agent cylinder becomes no less than a predetermined level, the outlet valve including:

a hose connection adapter installed at an outlet port which is the outlet side of the fire extinguishing agent cylinder and to which the fire extinguishing agent hose is connected;

an opening and closing member installed at an inner side of the hose connection adapter for opening and closing an outlet hole of the outlet port such that the opening and closing member is configured to be movable by the pressure of the fire extinguishing agent of no less than the predetermined level acting through the outlet hole of the outlet port, on the opening and closing member, thereby opening the outlet hole of outlet port; and a valve spring providing elastic restoring force, in a direction of closing the outlet hole of the outlet port, on the opening and closing member by being installed at the inner side of the hose connection adapter to elastically support the opening and closing member.

6. The system of claim 1, wherein the fire extinguishing agent cylinder further includes:

a piston installed to divide an inner space of the fire extinguishing agent tank into an air chamber in which the compressed air is supplied and a fire extinguishing agent chamber in which the fire extinguishing agent is filled and pressurizing for the fire extinguishing agent filled in the fire extinguishing agent tank to be discharged at the outlet port, by moving with the pressure of the compressed air supplied to the air chamber.

7. The system of claim 6, wherein the fire extinguishing agent tank further includes:

an inlet side cap and an outlet side cab installed to seal the main body by being coupled to opposite ends of the protection cover, respectively.

8. The system of claim 7, wherein each of the main body and the protection cover is formed as a cylindrical tube having open opposite ends, and the inlet side cap and the outlet side cap are fastened to the protection cover.

9. The system of claim 7, wherein a pad of elastic material is attached to an inner surface of each of the inlet side cap and the outlet side cap to seal a gap between each of the inlet side and outlet side caps and the main body, the inner surfaces of the caps sealing the main body by being in contact with the opposite ends of the main body, respectively.

10. The system of claim 1, wherein a plurality of the connection parts or a plurality of the coupling grooves is provided on each of the outer circumferential surface of the main body and the inner circumferential surface of the protection cover, and the plurality of the connection parts and the plurality of the coupling grooves are formed as continuous shapes along longitudinal directions of the main body and the protection cover, respectively.

11. The system of claim 1, wherein a thermal insulation material is installed into space between the main body and the protection cover.

12. The system of claim 7, wherein an air discharge port connected to the air chamber of an inner space of the main body is provided at the inlet side cap, a filling port connected to the fire extinguishing agent chamber of the inner space of the main body is provided at the outlet side cap, and plugs for sealing are detachably coupled to the air discharge port and the filling port, respectively.

* * * * *